US006905082B1

(12) United States Patent
Wu

(10) Patent No.: US 6,905,082 B1
(45) Date of Patent: Jun. 14, 2005

(54) SPRAYER DEVICE HAVING BUFFERING STRUCTURE

(76) Inventor: Sheng Li Wu, P.O. Box 63-99, Taichung (TW) 406

( * ) Notice: Subject to any disclaimer, the term of this patent is extended or adjusted under 35 U.S.C. 154(b) by 0 days.

(21) Appl. No.: 10/730,732

(22) Filed: Dec. 5, 2003

(51) Int. Cl.[7] ..... B05B 3/04
(52) U.S. Cl. ..... 239/436; 239/447
(58) Field of Search ..... 239/436, 440, 239/441, 443, 447, 448, 449, 461, 505, 533.1, 239/548, 553, 569, 570, 380, 381, 382

(56) References Cited

U.S. PATENT DOCUMENTS

| | | | | |
|---|---|---|---|---|
| 5,232,162 A | | 8/1993 | Chih | 239/394 |
| 5,333,792 A | | 8/1994 | Wang | 239/440 |
| 5,348,228 A | | 9/1994 | Wang | 239/394 |
| 6,164,566 A | * | 12/2000 | Hui-Chen | 239/394 |
| 6,273,343 B1 | | 8/2001 | Guo | 239/394 |
| 6,412,710 B1 | * | 7/2002 | Lin et al. | 239/436 |
| 6,612,507 B1 | * | 9/2003 | Meyer et al. | 239/394 |

* cited by examiner

*Primary Examiner*—David A. Scherbel
*Assistant Examiner*—Thach H. Bui
(74) *Attorney, Agent, or Firm*—Alan D. Kamrath; Nikolai & Mersereau, P.A.

(57) ABSTRACT

A sprayer device includes an opening formed by a peripheral wall, and a mouth for receiving water. A head is rotatably attached to the peripheral wall and includes a number of ports to be selectively aligned with the mouth, and to selectively receive water from the mouth. The head includes an outer peripheral portion having a number of apertures, a cover is secured to the head. A buffering plate is spaced from the cover to form a gap between the cover and the buffering plate. The cover includes one or more inlets for allowing the water to selectively flow through the inlets of the cover and flow into the gap formed between the cover and the buffering plate.

10 Claims, 5 Drawing Sheets

SPRAYER DEVICE HAVING BUFFERING STRUCTURE

BACKGROUND OF THE INVENTION

1. Field of the Invention

The present invention relates to a sprayer device, and more particularly to a sprayer device having a buffering structure to provide a slow flowing water pattern.

2. Description of the Prior Art

Various kinds of typical sprayer devices have been developed and comprise a rotatable head attached to a front portion of a sprayer gun body, and rotatable relative to the sprayer gun body to provide or to form various kinds of water spraying patterns.

For example, U.S. Pat. No. 5,232,162 to Chih, U.S. Pat. No. 5,333,792 to Wang, U.S. Pat. No. 5,348,228 to Wang, and U.S. Pat. No. 6,273,343 to Guo disclose four of the typical sprayer devices also having a rotatable head attached to the front portion of the sprayer gun body, and rotatable relative to the sprayer gun body to provide or to form various kinds of water spraying patterns.

However, the typical sprayer devices have no buffering structures to provide or to form slow flowing water patterns.

The present invention has arisen to mitigate and/or obviate the afore-described disadvantages of the conventional sprayer devices.

SUMMARY OF THE INVENTION

The primary objective of the present invention is to provide a sprayer device having a buffering structure to provide a slow flowing water pattern.

In accordance with one aspect of the invention, there is provided a sprayer device comprising a sprayer body including an opening formed therein and defined by a peripheral wall, and including a mouth for receiving water, a head rotatably attached to the peripheral wall of the sprayer body and including a plurality of ports formed therein and to be selectively aligned with the mouth of the sprayer body, to selectively receive water from the mouth of the sprayer body, the head including an outer peripheral portion having a plurality of apertures formed therein, a cover including a peripheral skirt extended therefrom and secured to the head, to form a chamber in the cover and the head, and including a plurality of holes formed therein and aligned with the ports of the head respectively, and a buffering plate received in the opening of the sprayer body and spaced from the cover, to form a gap between the cover and the buffering plate. The cover includes at least one inlet formed therein and communicating with the chamber of the cover and the head, to allow the water to selectively flow through the inlet of the cover and flow into the gap formed between the cover and the buffering plate, and then to flow out through the apertures of the head.

The buffering plate includes an orifice formed therein and aligned with the mouth, and holes of the cover are arranged to be selectively aligned with the orifice of the buffering plate and the mouth of the sprayer body.

The sprayer body includes at least one rib provided therein, the buffering plate includes at least one slot formed by at least one flap to receive the rib of the sprayer body, and to prevent the buffering plate from rotating relative to the sprayer body, and to maintain an alignment of the orifice of the buffering plate with the mouth of the sprayer body.

The sprayer body includes a spring biased projection provided therein, the cover includes a plurality of depressions formed therein for selectively receiving the spring biased projection, and for maintaining either of the holes of the cover in alignment with the mouth of the sprayer body.

The head includes a plurality of barrels extended therefrom and aligned with and holes of the cover respectively. The head includes a peripheral barrier extended therein to form an annular passage therein, and includes a number of perforations formed therein and communicating with the annular passage thereof, a first barrel of the barrels includes an outlet formed therein and communicating with the annular passage of the head, to allow the water to flow from the first barrel to the annular passage and to flow out through the perforations of the head.

The head includes at least one partition extended therefrom to couple the barrels together, and to form an intermediate channel and an outer channel in the head. The head includes a plurality of orifices formed therein and communicating with the outer channel thereof, a first barrel of the barrels includes an outlet formed therein and communicating with the outer channel of the head, to allow the water to flow from the first barrel to the outer channel and to flow out through the orifices of the head.

The cover further includes two entrances formed therein for selectively communicating with either or both the barrels, to allow the water to flow out through either or both the annular passage and the perforations of the head or the outer channel and the orifices of the head.

The intermediate channel of the head is communicated with the inlet of the cover, one of the barrels includes an outlet formed therein and communicating with the intermediate channel of the head, to allow the water to flow from the first barrel to the intermediate channel, and to flow out through the inlet of the cover, and to flow into the gap formed between the cover and the buffering plate, and then to flow out through the apertures of the head.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
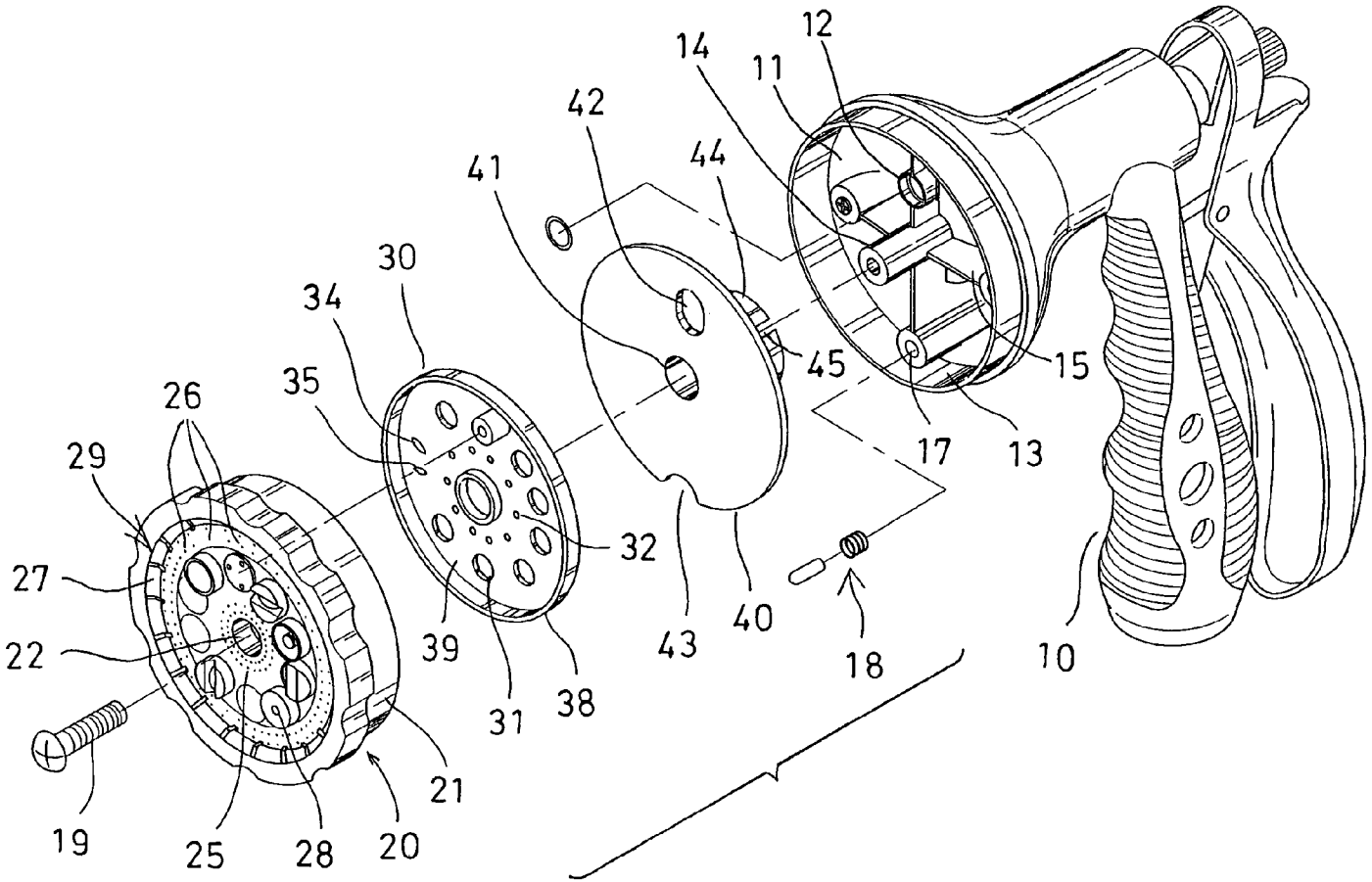
FIG. 1 is an exploded view of a sprayer device in accordance with the present invention, as seen from the front portion of the sprayer device.
Figure 2:
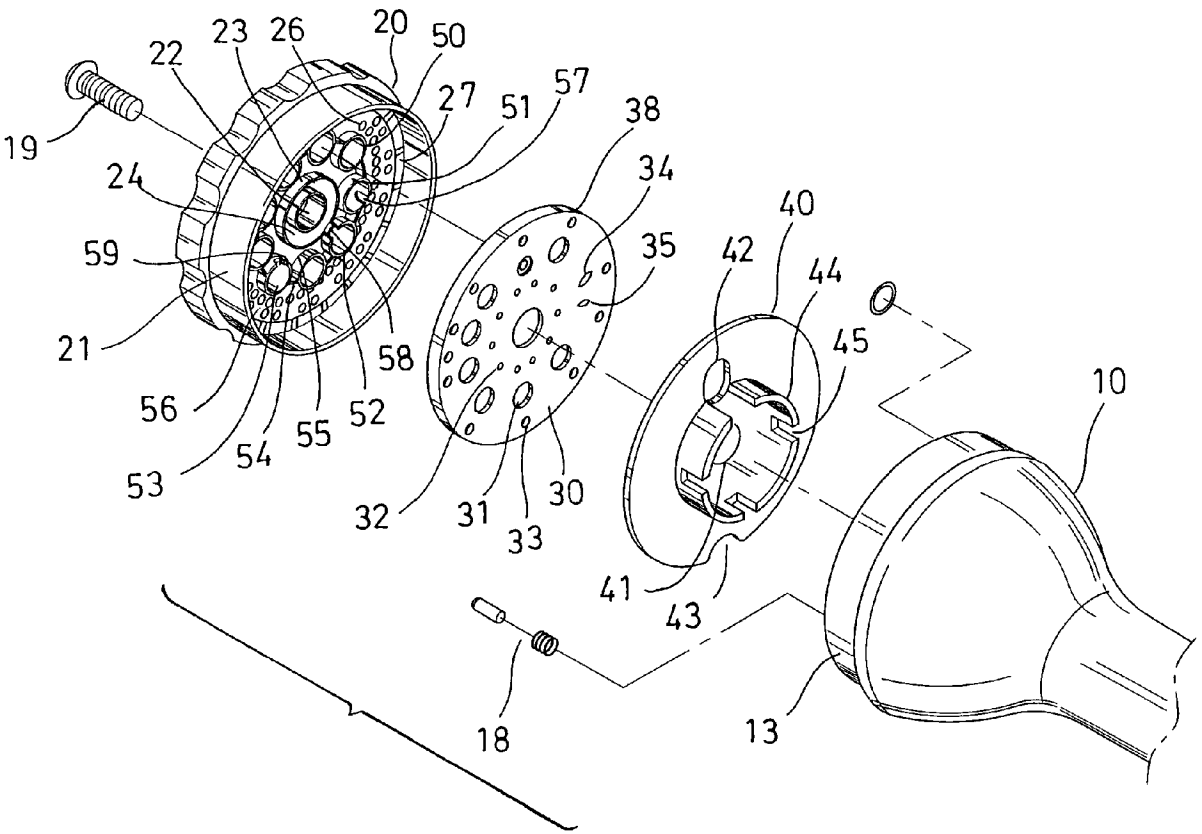
FIG. 2 is an exploded view of the sprayer device, as seen from the rear portion of the sprayer device.
Figure 3:
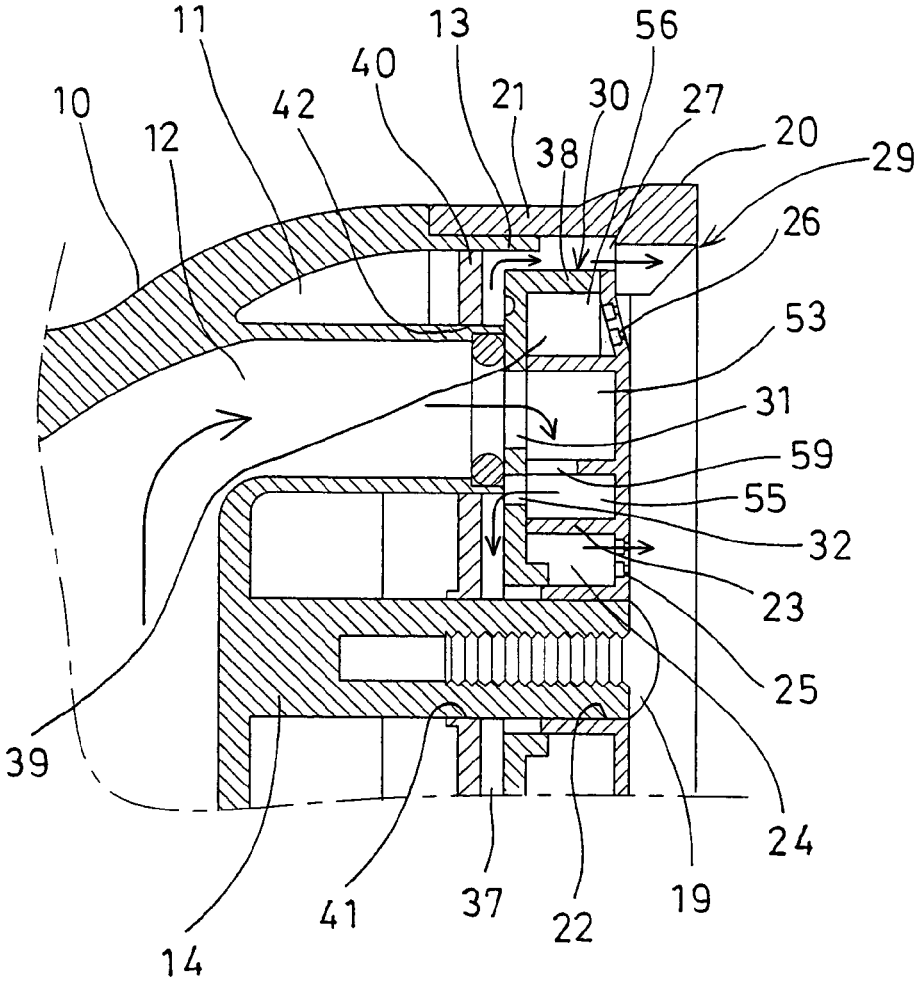
FIG. 3 is a partial cross sectional view of the sprayer device.

Referring to the drawings, and initially to FIGS. 1–3, a sprayer device in accordance with the present invention comprises a sprayer gun body or sprayer body 10 for coupling to water reservoirs, and including an opening 11 formed in the front portion thereof and defined by a peripheral wall 13, including a mouth 12 for receiving the water from the sprayer body 10 or from the water reservoirs.

The sprayer body 10 includes a hub 14 provided in the center portion thereof, and includes one or more ribs 15 formed or provided within the peripheral wall 13, for such as reinforcing purposes. The sprayer body 10 further includes a cavity 17 formed therein for receiving a spring biased projection 18.

Figure 4:
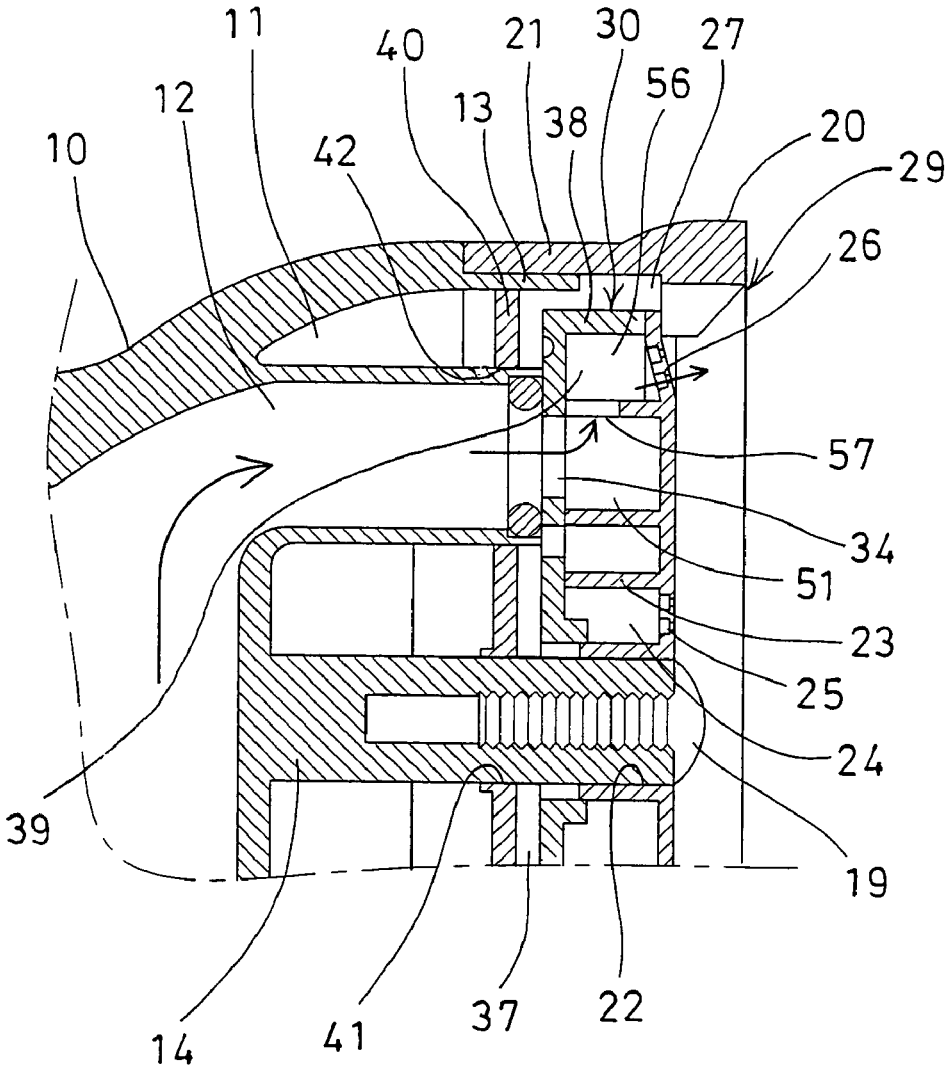
FIG. 4 is a partial cross sectional view similar to FIG. 3, illustrating the operation of the sprayer device.

A buffering plate 40 is slidably received in the opening 11 of the sprayer body 10, and preferably includes an outer contour or an outer diameter equals to or slightly smaller than the inner contour or the inner diameter of the peripheral wall 13, for allowing the buffering plate 40 to substantially block the opening 11 of the sprayer body 10, best shown in FIGS. 3, 4.

The buffering plate 40 includes a bore 41 formed in the center portion thereof for rotatably receiving the hub 14 of the sprayer body 10. The buffering plate 40 further includes an orifice 42 formed therein and aligned with the mouth 12, for allowing the mouth 12 to be engaged into the orifice 42 of the buffering plate 40 (FIGS. 3, 4). The buffering plate 40 further includes a notch 43 formed in the outer peripheral portion thereof and aligned with the spring biased projection 18, for allowing the spring biased projection 18 to be extended out through the notch 43 of the buffering plate 40.

The buffering plate 40 further includes one or more flaps 44 extended rearwardly therefrom to form or define one or more slots 45 therein, and for slidably receiving the ribs 15 of the sprayer body 10, and for limiting the buffering plate 40 to slide relative to the sprayer body 10 only, and for preventing the buffering plate 40 from rotating relative to the sprayer body 10, and for maintaining the alignment of the orifice 42 and the notch 43 thereof with the mouth 12 and the spring biased projection 18 respectively.

A head 20 includes a peripheral fence 21 for rotatably engaged onto the peripheral wall 13 of the sprayer body 10, and includes a center hole 22 formed therein to receive a fastener 19 which is engaged through the bore 41 of the buffering plate 40 and threaded to the hub 14 of the sprayer body 10, to rotatably secure the head 20 to the front portion of the sprayer body 10.

The head 20 includes a peripheral barrier 23 extended therein and formed around the center hole 22 thereof, to form an annular passage 24 therein, and includes a number of perforations 25 formed in the front portion thereof (FIG. 1) and communicating with the annular passage 24 thereof.

The head 20 further includes a number of cylindrical members or barrels 50, 51, 52, 53 extended therein, and disposed or arranged around the center hole 22 and the peripheral barrier 23 thereof, for selectively aligning with the mouth 12 of the sprayer body 10, to receive the water from the water reservoirs or from the mouth 12 of the sprayer body 10.

The barrels 50, 51, 52, 53 of the head 20 are coupled together with one or more partitions 54, to separate the inner portion of the head 20 into an intermediate channel 55 and an outer channel 56 that are formed around the peripheral barrier 23 of the head 20. The intermediate channel 55 is formed between the peripheral barrier 23 and the barrels 50, 51, 52, 53 and the partitions 54 of the head 20.

The head 20 further includes a number of orifices 26 formed therein and aligned with the outer channel 56 thereof, and includes a number of apertures 27 formed in the outer peripheral portion 29 thereof and formed around the orifices 26 thereof, and includes a number of ports 28 formed in the inner peripheral portion thereof, or formed between the orifices 26 and the perforations 25 thereof, and aligned with the barrels 50 respectively, for forming various water flowing patterns.

The barrel 51 includes an outlet 57 formed therein and communicating with the outer channel 56 of the head 20, to allow the water to flow from the barrel 51 to the outer channel 56 and to flow out through the orifices 26 of the head 20 (FIGS. 2, 4).

The other barrel 52 includes an outlet 58 formed therein (FIG. 2) and communicating with the annular passage 24 of the head 20, to allow the water to flow from the barrel 52 to the annular passage 24 and to flow out through the perforations 25 of the head 20.

The further barrel 53 includes an outlet 59 formed therein (FIGS. 2, 4) and communicating with the intermediate channel 55 of the head 20, to allow the water to flow from the barrel 53 to the intermediate channel 55 of the head 20.

A cover 30 includes a peripheral skirt 38 extended therefrom and engaged onto and secured to the head 20 with such as adhesive materials, welding processes, or the like, to form a chamber 39 therein, and to be formed as an integral piece or portion of the head 20. The peripheral skirt 38 of the cover 30 may be used to separate the apertures 27 and the orifices 26 of the head 20 away from each other, best shown in FIGS. 3 and 4.

The cover 30 is engaged onto and secured to the barrels 50, 51, 52, 53 and the partitions 54 and the peripheral barrier 23 of the head 20 with such as adhesive materials, welding processes, or the like, to enclose the intermediate channel 55 and the annular passage 24 and the outer channel 56 of the head 20.

The cover 30 includes a number of holes 31 formed therein and aligned with the barrels 50 respectively, and to be selectively aligned with the mouth 12 of the sprayer body 10, to allow the water to flow from the mouth 12 of the sprayer body 10 through either of the barrels 50 and the respective ports 28 of the head 20, and to form different water spraying patterns when the head 20 is rotated relative to the sprayer body 10.

The cover 30 includes a number of inlets 32 formed therein and arranged around the fastener 19, and communicating with the intermediate channel 55 of the head 20, for communicating the intermediate channel 55 of the head 20 with a gap 37 formed between the cover 30 and the buffering plate 40 (FIGS. 3, 4).

Figure 5:
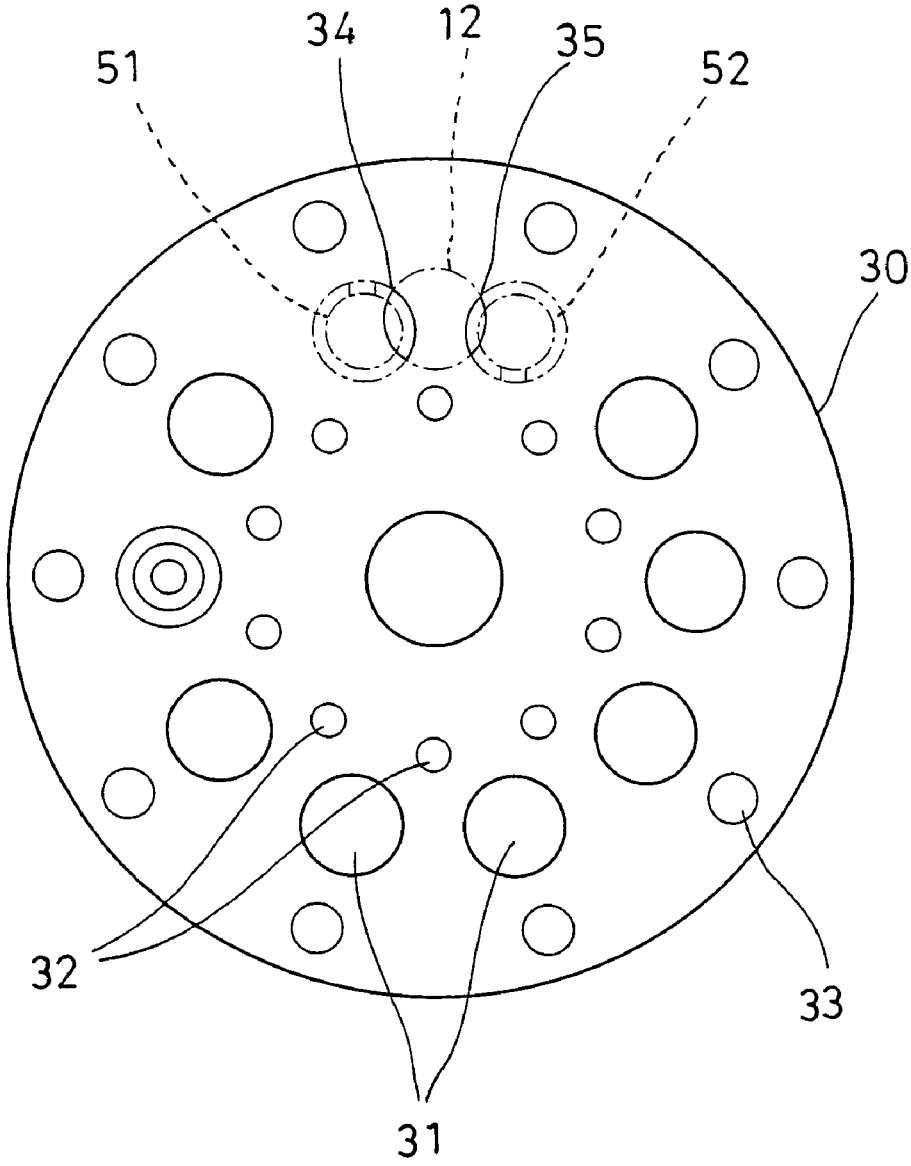
FIG. 5 is a front plan view of the sprayer device, illustrating the operation of the sprayer device.

The cover 30 further includes two entrances 34, 35 formed therein and communicating with the barrels 51, 52 respectively, to allow the water to flow from the mouth 12 toward either or both the barrels 51, 52, best shown in FIG. 5, and thus to allow the water to flow out through either or both the annular passage 24 and the perforations 25 of the head 20 or the outer channel 56 and the orifices 26 of the head 20.

The holes 31 and the entrances 34, 35 of the cover 30 are arranged to be selectively aligned with the mouth 12 when the cover 30 and the head 20 are rotated relative to the sprayer body 10, best shown in FIG. 5. The cover 30 further includes a number of depressions 33 formed therein for selectively receiving the spring biased projection 18, and for maintaining the alignment of either of the holes 31 and the entrances 34, 35 of the cover 30 with the mouth 12 of the sprayer body 10.

In operation, as shown in FIG. 3, when the hole 31 that is aligned with the barrel 53 is aligned with the mouth 12 to receive water from the mouth 12, the water may flow through the outlet 59 of the barrel 53 and to flow into the intermediate channel 55 of the head 20, and then to flow out of the cover 30 through the inlets 32 of the cover 30 and into the gap 37 formed between the cover 30 and the buffering plate 40, and may then flow out through the apertures 27 of the head 20.

It is to be noted that the water may be slowed down and may thus flow out through the apertures 27 of the head 20 with decreased flowing speeds. In addition, when the water flowing out through the inlets 32 of the cover 30 and into the gap 37 formed between the cover 30 and the buffering plate 40, the buffering plate 40 may be slightly moved relative to the sprayer body 10 to further buffer or to slow down the water.

Accordingly, the sprayer device in accordance with the present invention includes a buffering structure to provide a slow flowing water pattern.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprayer device comprising:

a sprayer body including an opening formed therein and defined by a peripheral wall, and including a mouth for receiving water, said sprayer body including a spring biased projection provided therein, a head rotatably attached to said peripheral wall of said sprayer body and including a plurality of ports formed therein and to be selectively aligned with said mouth of said sprayer body, to selectively receive water from said mouth of said sprayer body, said head including an outer peripheral portion having a plurality of apertures formed therein, a cover including a peripheral skirt extended therefrom and secured to said head, to form a chamber in said cover and said head, and including a plurality of holes formed therein and aligned with said ports of said head respectively, and a buffering plate received in said opening of said sprayer body and spaced from said cover, to form a gap between said cover and said buffering plate, and said cover including at least one inlet formed therein and communicating with said chamber of said cover and said head, to allow the water to selectively flow through said at least one inlet of said cover and flow into said gap formed between said cover and said buffering plate, and then to flow out through said apertures of said head, and said cover including a plurality of depressions formed therein for selectively receiving said spring biased projection, and for maintaining either of said holes of said cover in alignment with said mouth of said sprayer body.

2. The sprayer device as claimed in claim 1, wherein said buffering plate includes an orifice formed therein and aligned with said mouth, and holes of said cover are arranged to be selectively aligned with said orifice of said buffering plate and said mouth of said sprayer body.

3. The sprayer device as claimed in claim 2, wherein said sprayer body includes at least one rib provided therein, said buffering plate includes at least one slot formed by at least one flap to receive said at least one rib of said sprayer body, and to prevent said buffering plate from rotating relative to said sprayer body, and to maintain an alignment of said orifice of said buffering plate with said mouth of said sprayer body.

4. A sprayer device comprising:

a sprayer body including an opening formed therein and defined by a peripheral wall, and including a mouth for receiving water, a head rotatably attached to said peripheral wall of said sprayer body and including a plurality of ports formed therein and to be selectively aligned with said mouth of said sprayer body, to selectively receive water from said mouth of said sprayer body, said head including an outer peripheral portion having a plurality of apertures formed therein, a cover including a peripheral skirt extended therefrom and secured to said head, to form a chamber in said cover and said head, and including a plurality of holes formed therein and aligned with said ports of said head respectively, a buffering plate received in said opening of said sprayer body and spaced from said cover, to form a gap between said cover and said buffering plate, said cover including at least one inlet formed therein and communicating with said chamber of said cover and said head, to allow the water to selectively flow through said at least one inlet of said cover and flow into said gap formed between said cover and said buffering plate, and then to flow out through said apertures of said head, and said head including a plurality of barrels extended therefrom and aligned with and holes of said cover respectively.

5. The sprayer device as claimed in claim 4, wherein said head includes a peripheral barrier extended therein to form an annular passage therein, and includes a number of perforations formed therein and communicating with said annular passage thereof, a first barrel of said barrels includes an outlet formed therein and communicating with said annular passage of said head, to allow the water to flow from said first barrel to said annular passage and to flow out through said perforations of said head.

6. The sprayer device as claimed in claim 4, wherein said head includes at least one partition extended therefrom to couple said barrels together, and to form an intermediate channel and an outer channel in said head.

7. The sprayer device as claimed in claim 6, wherein said head includes a plurality of orifices formed therein and communicating with said outer channel thereof, a first barrel of said barrels includes an outlet formed therein and communicating with said outer channel of said head, to allow the water to flow from said first barrel to said outer channel and to flow out through said orifices of said head.

8. The sprayer device as claimed in claim 7, wherein said head includes a peripheral barrier extended therein to form an annular passage therein, and includes a number of perforations formed therein and communicating with said annular passage thereof, a second barrel of said barrels includes an outlet formed therein and communicating with said annular passage of said head, to allow the water to flow from said first barrel to said annular passage and to flow out through said perforations of said head.

9. The sprayer device as claimed in claim 8, wherein said cover further includes two entrances formed therein for selectively communicating with either or both said first and said second barrels, to allow the water to flow out through either or both said annular passage and said perforations of said head or said outer channel and said orifices of said head.

10. The sprayer device as claimed in claim 6, wherein said intermediate channel of said head is communicated with said at least one inlet of said cover, a first barrel of said barrels includes an outlet formed therein and communicating with said intermediate channel of said head, to allow the water to flow from said first barrel to said intermediate channel, and to flow out through said at least one inlet of said cover, and to flow into said gap formed between said cover and said buffering plate, and then to flow out through said apertures of said head.

* * * * *